United States Patent [19]

Hanson

[11] Patent Number: 4,521,456

[45] Date of Patent: Jun. 4, 1985

[54] APPLICATOR NOZZLE

[75] Inventor: Raymond Hanson, Rearsby, England

[73] Assignee: USM Corporation, Farmington, Conn.

[21] Appl. No.: 525,122

[22] Filed: Aug. 22, 1983

[30] Foreign Application Priority Data

Aug. 20, 1982 [GB] United Kingdom ..... 8224033

[51] Int. Cl.[3] ..... B05B 11/00

[52] U.S. Cl. ..... 427/207.1; 427/286; 118/410; 401/139

[58] Field of Search ..... 427/286, 207.1; 118/410; 401/139, 264, 266; 222/575

[56] References Cited

U.S. PATENT DOCUMENTS

| | | | |
|---|---|---|---|
| 2,069,256 | 2/1937 | MacKenzie | 91/43 |
| 2,100,341 | 11/1937 | MacKenzie | 91/43 |
| 2,294,472 | 9/1942 | MacKenzie | 12/80 |
| 2,552,853 | 5/1951 | Isserstedt | 401/266 |
| 3,093,274 | 6/1963 | Galbierz | 222/566 X |
| 3,536,411 | 10/1970 | Eisert | 401/266 X |
| 3,628,500 | 12/1971 | Matlock | 118/3 |

FOREIGN PATENT DOCUMENTS

| | | | |
|---|---|---|---|
| 65875 | 12/1982 | European Pat. Off. . | |
| 2359413 | 6/1975 | Fed. Rep. of Germany | 118/410 |
| 1211867 | 3/1960 | France | 118/410 |
| 2263040 | 10/1975 | France . | |
| 284412 | 2/1928 | United Kingdom . | |

*Primary Examiner*—Shrive p. Beck

*Attorney, Agent, or Firm*—Donald N. Halgren

[57] ABSTRACT

Applicator nozzles for applying a band of liquid composition e.g. hot melt adhesive to a workpiece using a hand-held applicator have been unsuitable for some purposes. By this invention a nozzle is provided comprising a resiliently flexible applicator portion terminating in a spreading lip of triangular section, bounding a depression and having an orifice e.g. cruciform in shape, opening into the depression, through which orifice material to be applied is supplied to provide a reservoir of composition in the depression. In a preferred nozzle the lip is defined by a frusto-conical outer surface and a surface of the depression meeting at an effectively circular spreading edge portion. In use the nozzle is placed on a workpiece the reservoir of composition forming a pool on the workpiece, the nozzle axis being tilted so that only a trailing edge of the lip contacts the workpiece as composition is applied.

3 Claims, 4 Drawing Figures

APPLICATOR NOZZLE

BACKGROUND OF THE INVENTION

1. The Field of the Invention

This invention is concerned with an applicator nozzle for applying a band of liquid composition, especially a viscous liquid adhesive composition e.g. hot melt adhesive composition to a surface.

2. Description of the Prior Art

In the field of adhesive bonding it is known to apply adhesive composition in fluid condition to a workpiece. It is well known for example to apply hot melt adhesives by means of static applicators or hand-held applicators. Hot melt adhesives used in production of many types of articles are of a kind which achieve their adhesive properties by mere setting of the composition on cooling. However, it has been proposed to employ in certain trades adhesive compositions which achieve at least some of their adhesive properties by virtue of a curing reaction, which may be effected for example by atmospheric moisture. With such compositions it is desirable to provide means for dispensing and applying the composition, which means is capable of continued production operation despite clogging of the applicator nozzle which may result from curing of the composition in the mechanism. It is thus convenient to provide an arrangement whereby the applicator nozzle may be readily cleaned.

It has been proposed to employ applicator nozzles of silicone rubber composition for applying heated compositions to workpieces and which are provided with a resiliently flexible applicator portion. One nozzle which has been proposed for use in applying viscous, liquid, hot melt adhesive compositions is described in our U.S. Pat. No. 4,419,393 and comprises a tapering applicator portion which is resiliently flexible and is provided with an adhesive guiding surface which extends to a narrow terminal spreading surface of the applicator portion, the adhesive-guiding surface being concave about an axis which extends transversely of the spreading surface, and an elongated orifice opening through the adhesive-guiding surface and extending generally parallel to the spreading surface. Such an applicator nozzle has been found suitable for use in static applicators but is not well adapted for use in hand-held applicators, at least for certain applications. For example, it is sometimes necessary to apply a band of adhesive to a workpiece surface on a curved path, e.g. in cementing edge portions of shoe soles, and this is difficult, using a nozzle as referred to above in a hand-held applicator because of manipulation difficulties in ensuring that the nozzle has appropriate orientation relative to direction of travel along the path.

BRIEF SUMMARY OF THE INVENTION

Essentially, the invention presents to the art a novel, improved applicator nozzle for applying a band of liquid composition to a surface. The novel nozzle comprises a resiliently flexible applicator portion terminating in a spreading lip of substantially triangular section bounding a depression formed at a terminal portion of the applicator portion and having an orifice opening into the depression. In using the nozzle, the composition to be supplied is supplied through the orifice to provide a reservoir of composition in the depression.

The invention further provides a method of applying a band of liquid adhesive to a surface of a workpiece using a novel applicator nozzle of the invention.

DESCRIPTION OF PREFERRED EMBODIMENTS

Figure 1:
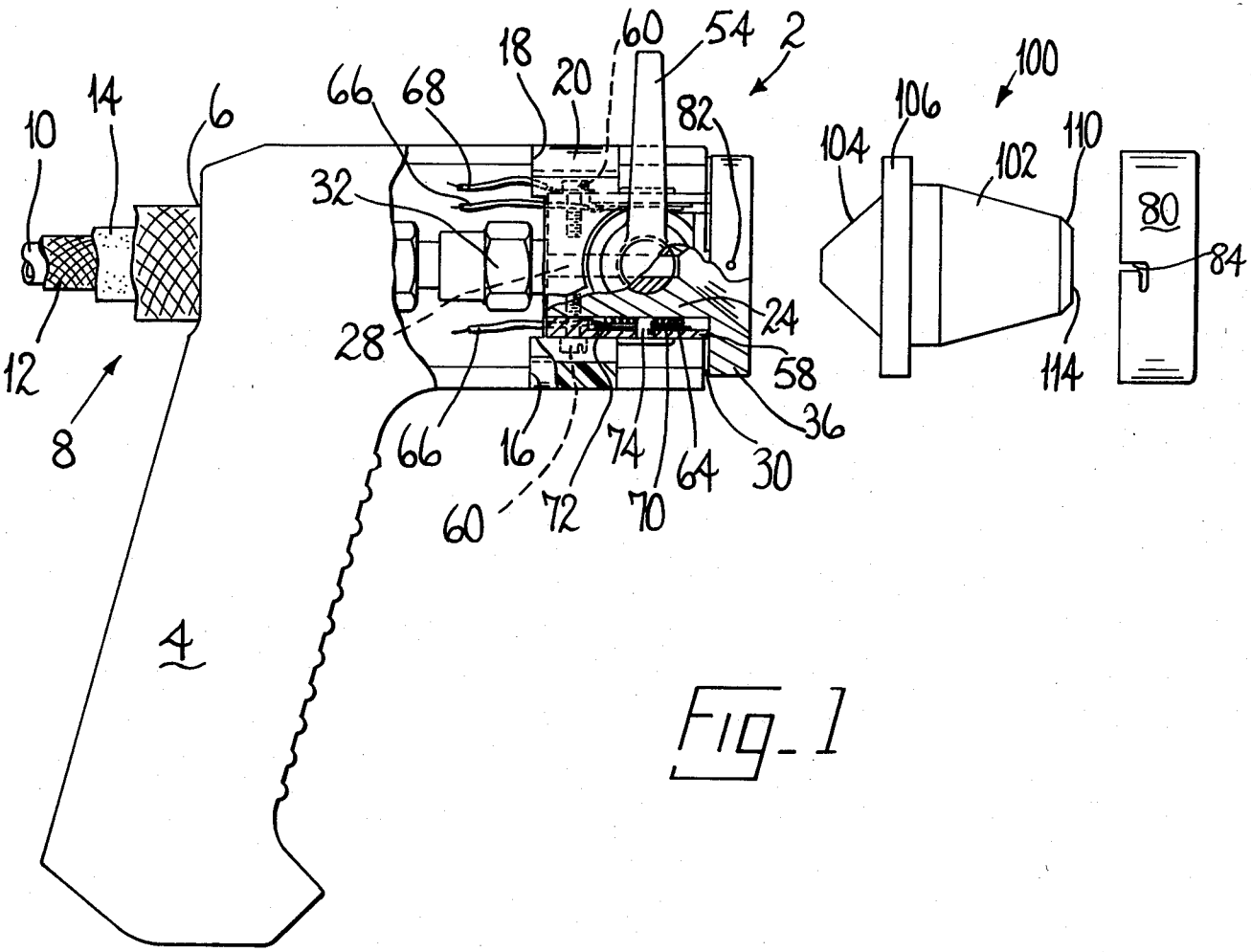
FIG. 1 is a side view, partly in section, of an applicator device.

The invention provides in one of its aspects an applicator nozzle for applying a band of liquid composition to a surface, the nozzle comprising a resiliently flexible applicator portion terminating in a spreading lip of substantially triangular section bounding a depression formed at a terminal portion of the applicator portion and having an orifice opening into the depression through which orifice composition to be applied is supplied in the use of the nozzle, to provide a reservoir of composition in the depression.

Preferably, the angle subtended by sides of the triangular section of the lip of a nozzle in accordance with the invention meeting at a spreading edge portion of the lip is between 30° and 80°, more preferably about 70°.

Preferably the lip of a nozzle in accordance with the invention is defined by a frusto-conical outer surface of the applicator portion and a surface of the depression, meeting at an effectively circular spreading edge portion of the lip.

The invention also provides in another of its aspects an applicator nozzle for applying a band of liquid adhesive to a surface, the nozzle comprising an applicator portion which is resiliently flexible and which comprises a spreading lip having a narrow terminal effectively circular spreading edge portion, within the circular spreading edge portion a guiding surface provided by a surface of a depression formed in a terminal portion of the applicator portion, a frusto-conical outer surface of the applicator portion tapering towards the spreading edge portion, the outer surface and guiding surface meeting at the spreading edge portion, and an orifice opening through the guiding surface into the depression through which orifice material to be applied is supplied in the use of the applicator nozzle to provide a reservoir of material in the depression.

Suitably the applicator portion of a nozzle in accordance with the invention is made of a material having a hardness on the International Rubber Hardness Scale of between 30 and 65, preferably about 40.

In using a nozzle in accordance with the invention to apply a band of a particular liquid composition, e.g. a viscous hot melt adhesive composition to a workpiece, the thickness of the layer of composition applied to the workpiece is dependent upon the flexibility of the spreading lip of the applicator portion: a flexible lip applies a thicker layer of composition than a more rigid lip. The flexibility of the lip is itself dependent on the hardness of the material and the bulk of material in the lip (assuming that the material itself has sufficient inherent flexibility, toughness and resilience to recover from deformation), the bulk of material in the lip being dependent on the angle subtended at the spreading edge portion by the surfaces (meeting at the spreading edge portion) of the lip. The flexibility of the lip is thus conveniently selected by appropriate selection of the angle subtended by the surfaces of the lip at the spreading edge portion or of a material of suitable hardness, or both.

A preferred material for manufacture of the applicator portion of a nozzle in accordance with the invention is a silicone rubber composition, from which the nozzle may conveniently be cast: the hardness of silicone rubber compositions may be adjusted over a wide range by suitable choice of components. Silicone rubber presents a non-stick surface to many compositions including most hot melt adhesives: it is preferred that the material of the nozzle be non-stick (even when the composition has hardened) so that surplus composition can be readily removed from the nozzle.

Preferably the orifice in the applicator portion is cruciform: an orifice of this shape is such that pressure applied to part of the spreading edge portion of the nozzle during application of composition to a workpiece tends to open at least one of the limbs of the orifice permitting unobstructed flow of the composition to the reservoir in the depression during application. The limbs of the orifice are preferably as thin as possible (to provide a satisfactory closure of the orifice when the nozzle is not in use): suitably the limbs are between 0.2 mm and 1 mm thick.

As well as influencing the angle subtended by the surfaces of the lip at the spreading edge portion of a preferred nozzle in accordance with the invention, the apex angle of the frusto-conical outer surface should be selected to reduce the risk that this surface might foul the applied band of composition: it is preferred that the apex angle of the frusto-conical outer surface of the applicator portion lies between 40° and 90°, suitably about 65°.

In a preferred nozzle in accordance with the invention the depression is substantially part spherical: the maximum depth of the depression is preferably substantially the same as the axial width of the frusto-conical outer surface of the applicator portion.

Conveniently a nozzle in accordance with the invention comprises a frusto-conical main body portion tapering towards an outer end portion at which the applicator portion is disposed. Suitably this main body portion has a smaller apex angle than the frusto-conical outer surface of the applicator portion. Where it is wished to apply liquid composition to a surface of a workpiece adjacent a corner of the workpiece, for example to the attaching surface of a walled sole unit adjacent the wall, it is desirable that the apex angle of the main body portion be sufficiently small to enable the layer to be applied close enough to the edge of the workpiece surface but, at the same time, the main body portion must be sufficiently rigid for the operator to adequately control movement of the applicator portion which would call for a larger apex angle: it is therefore necessary to choose a suitable compromise. The apex angle of the main body portion is chosen to be as low as possible and suitably lies between 10° and 45°, preferably not more than 30°.

Conveniently a nozzle in accordance with the invention comprises an external flange remote from the applicator portion by which the nozzle may be secured to an applicator device.

Preferably a nozzle in accordance with the invention comprises a protuberance at an end portion of the nozzle remote from the applicator portion, the protuberance being arranged to seat in a seating of an applicator device, the nozzle having a passage from the protuberance through the nozzle to the orifice so disposed that when the protuberance is seated in the seating of the applicator device the passage is connected to an outlet port of the applicator device through which liquid composition can be delivered to the passage and thence to the orifice.

The invention provides in a further aspect a method of applying a band of liquid adhesive to a surface of a workpiece using an applicator nozzle in accordance with the invention comprising supplying liquid composition to the orifice so that the adhesive flows through the orifice providing a reservoir of composition in the depression, with the applicator nozzle tilted with respect to the work bringing part of the lip and the surface of the workpiece substantially into contact so that the reservoir of composition forms a pool on the surface of the workpiece, causing the applicator portion to flex so that the applicator portion is deformed by contact with the workpiece surface, and bringing about relative movement between the applicator nozzle and workpiece so that composition from the pool is spread in a band on the surface by the applicator portion, the pool preceding the part of the lip which is substantially in contact with the surface of the workpiece considering motion of the applicator relative to the workpiece.

In a method in accordance with the invention the nozzle is tilted with respect to the workpiece surface sufficiently to permit the operator to manipulate the applicator device comfortably while ensuring that a leading part of the spreading edge portion is spaced from the surface (to avoid damage to the nozzle) and that the outer surface of the lip does not foul the applied band of composition. Suitably the central axis of the nozzle is tilted so that it makes an angle of between 88° and 60° with the surface of the workpiece. Suitably, prior to flexing the applicator portion a surface of the depression of the applicator portion adjacent the spreading edge portion where it contacts the surface makes an angle of between 55° and 83° with the surface of the workpiece.

The invention provides in yet another of its aspects an applicator device for liquid adhesive having a nozzle according to the invention secured thereto. Conveniently the applicator device comprises valve means by which flow of liquid composition to the orifice can be controlled.

There now follows a detailed description, to be read with reference to the accompanying drawings, of an applicator nozzle suitable for use in the application of hot melt adhesives. It will be realized that this nozzle has been selected for description to illustrate the invention by way of example.

The illustrative applicator nozzle (100) is suitable for use in applying a band of liquid composition e.g. melted adhesive e.g. Bostik PA5102 to a surface. The illustrative nozzle is resiliently flexible and is attached to a forward portion of a suitable applicator device (described in detail hereinafter). The illustrative applicator nozzle is formed from a resiliently flexible cured silicone rubber composition of hardness on the International Rubber Hardness Scale of 40 by moulding the composition in a suitably shaped mold. The applicator nozzle comprises a frusto-conical main body portion (102) tapering towards a frusto-conical outer surface (110) of a circular spreading lip (112). The apex angle (α) of the frusto-conical outer surface (110) is larger than the apex angle (β) of the frusto-conical body portion (102). In the nozzle (110), the angle (α) is about 65° and the angle (β) is about 30°.

The spread1ng lip (112) is of substantially triangular section and is defined by the frusto-conical outer surface (110) and the surface (118) of a depression (116) meeting at a spreading edge portion (114) of the lip, an angle of 70° being subtended by the surfaces (110, 118) at the edge portion (114). The spreading edge portion (114) is circular viewed from the end and, as will be explained hereinafter serves to apply the composition to the surface of a workpiece in a substantially uniform band, the thickness of which is substantially unaffected by the pressure applied to the nozzle. The spreading edge portion (114) circumscribes the depression (116) which is formed at a terminal portion of the applicator portion. The depression is part spherical with a depth substantially equal to the axial width of the outer surface (110). An orifice (120) opens into the depression through which orifice composition to be applied to the surface of a workpiece is supplied. The orifice (120) is cruciform (viewed from the end) and each of the limbs of the orifice (120) is narrow, preferably not more than 1 mm wide and suitable between 0.5 mm and 1 mm and each limb is conveniently about ¼ of the diameter of the edge portion (114) in length.

The composition is supplied to the orifice (120) through an exit passageway (108) which is located in the nozzle so that it registers with an outlet port (76) of the applicator device.

The depression (116) provides for a reservoir of composition and the surface (118) of the depression provides an adhesive guiding surface when the applicator nozzle is brought into contact with a surface of a workpiece.

The applicator nozzle (100) also comprises an external flange (106) remote from the applicator portion and a protuberance (104) at the end portion of the nozzle remote from the applicator portion.

One suitable applicator device is shown in the drawings. This applicator device comprises a body portion (2) adapted to be held in the hand of an operator. The body portion comprises two molded plastic portions (4) adapted to be secured together to form a handle. Each portion (4) is formed with an aperture (6) to loosely accommodate entry of a flexible hose (8) at a rearward portion of the handle. Each portion is formed with openings (16) and (18) to accommodate upper and lower lugs of a mounting block (20) and of such a size to secure the mounting block in position in the handle. The mounting block is formed from Delrin, and is adapted to receive a brass core (22) located on spacer portions of the mounting block (20) and secured to the mounting block by a screw (26). A forward portion of the core (22) supports an insulating washer (30) of PTFE located between a shoulder (36) of the core and forward ends of the plastic portions (4).

The brass core (22) provides a heat conductive and electrically conductive member and comprises a main element (24) and upper and lower 'L' shaped elements (58). The main element is provided with a threaded boss (not shown) adapted to receive a threaded connector (32) on a forward portion of the flexible hose (8). A forward portion of the main element is provided with a conical recess (34). A bore (28) extends through the main element and the boss, and into the center of the recess (34), thus providing a supply passageway for connection with the flexible hose through which a composition may be supplied to the conical recess (34).

Valve means (42) is provided at the forward end of the bore (28) for controlling supply of composition through the bore (28). A valve bore (44) intersects the bore (28) at right angles and receives a metal valve rod (46). The metal valve rod (46) extends beyond the length of the valve bore (44) and is provided with a valve limit control (50) and a threaded boss (52) for attachment of a valve trigger (54). The valve rod (46) is positioned in the valve bore (44) by means of a nut and collar arrangement (40). The metal rod contains a transverse bore (48) located for registration with the bore (28). The valve rod (46) may be rotated by means of the valve trigger (54) to an extent determined by the valve limit control (50) and a stop (not shown) located on the shoulder (36). The supply of composition through the supply passageway is a maximum at the limit where the transverse valve bore (48) is in full alignment with the bore (28).

Rearward end portions of the 'L' shaped elements (58) are located on opposite surfaces of the main element and secured thereto by means of screws (60). The long sides of the 'L' shaped elements extend the length of the main element and abut against the shoulder (36), so that a space (62) exists between the long side of each 'L' shaped element (58) and the main element (24).

The supply passageway is heated by means of self-regulating positive temperature coefficient (PTC) heating elements (64).

These PTC heating elements (64) are semi conductors which have a characteristic switching temperature defined as the higher of the two temperatures at which the resistance of the PTC heating element is twice its minimum resistance.

Initially they exhibit a slight decrease in the resistance with an increase in the temperature, however, above a particular temperature the PTC heating elements (64) exhibit a sharp increase in the resistance for only a small rise in the temperature. This provides for a self regulating heating effect as a slight increase in the temperature will cause a decrease in the power consumption and conversely a small fall in the temperature will cause a corresponding increase in the power consumption such that the temperature remains substantially constant.

The PTC heating elements used in the applicator device are available from Phillips designated as PTC Thermistor, Catalogue Number 2322 663 95005 16V DC/12V AC and have a switching temperature of 120° C. The working temperature of the PTC heating elements (64) in the applicator device is approximately that of the switching temperature. As a result of heat loss in the conductive members this enables the surface of the bore (28) to be maintained at a temperature of about 105° C.

The PTC elements (64) are disk-shaped and are located one on either side of the main element (24) in a heat conductive relationship therewith and so as to provide means for heating the brass core (22) to a required temperature. Power is supplied to the PTC heating elements (64) by means of leads (66) connected to copper washers (70) which are in an electrically conducting relationship with the associated one of the PTC heating elements. Each of the PTC heating elements is located by a Delrin (acetal resin) insulating stud (74) which passes through a hole in the center of the PTC heating element disk, ensuring that the faces of the element (64) are electrically insulated from one another.

The faces of the PTC heating elements adjacent the 'L' shaped elements are electrically insulated therefrom by means of a sheet (72) comprising a glass cloth impregnated with silicone which, although electrically insulating, is a good conductor of heat. One assembly comprising the sheet (72), copper washer (70) and PTC heating element (64) is located in the space (62) between the long side of each of the 'L' shaped elements (58) and the main element by means of the insulating stud (74) which passes through holes in the associated 'L' shaped element, sheet, copper washer and PTC heating element and rests on the outer surface of the main element (24).

The flexible hose (8) through which adhesive composition may be supplied to the applicator device, is secured to the main element (24) by means of a threaded connection (32), said hose comprising an inner tube of PTFE (10) and a metal braiding (12). Leads for power supply to the PTC heating element (64), earth return (68) and a thermocouple (not shown) for the hose are enclosed in a PVC casing (14). In order to reduce the heating necessary in the supply passageway of the applicator device, the composition in the flexible hose is heated by means of resistance heating in which a low voltage is applied across the ends of the metal braiding (12). The temperature of the composition in the hose is controlled by means of the thermocouple (not shown) which is inserted mid-way along the length of the flexible hose.

The applicator device comprises means for locating the illustrative applicator nozzle in sealing engagement on the brass core (22), said means comprising an annular retaining element (80) for engaging the flange (106) of the nozzle, arranged to be secured to the brass core (22) by means of pin and socket connections. Two pin and socket connections are provided and each comprises a pin (82) located on the shoulder (36) and an 'L' shaped slot (84) formed in the retaining element (80); each is arranged in such a way that when the retaining element is moved to secure the illustrative applicator nozzle to the brass core, axially extending portions of the slots receive the pins (82). The annular retaining element (80) is secured to the brass core (22) by means of an axial movement to insert the pins (82) into the sockets (84), followed by a rotary movement to fasten the two members together.

In assembling the applicator nozzle (100) with the applicator device, the protuberance (104) of the nozzle (100) is arranged to be seated in the conical recess (34) provided by the main element (24) of the applicator device so that when the protuberance is sealed in the conical recess the exit passageway (108) is connected to an outlet port (76) of the applicator device through which outlet port liquid composition can be delivered to the exit passageway and from thence to the orifice (120). The external flange (106) is supported by a flange (78) surrounding the conical recess (34). The annular retaining element (80) is positioned on the exposed surface of the flange (106) and is secured to the conductive member (22) by means of the pin and socket connection as aforesaid, thereby securing the nozzle (100) to the applicator device.

Figure 2:
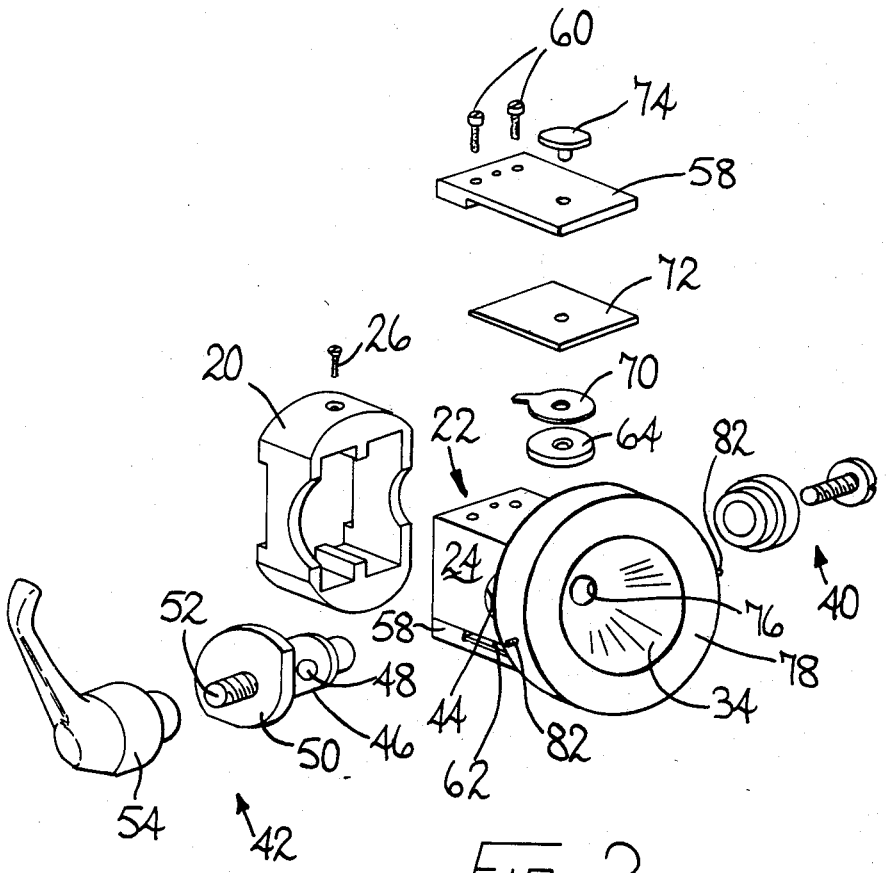
FIG. 2 is an exploded perspective view of parts of the device shown in FIG. 1.
Figure 3:
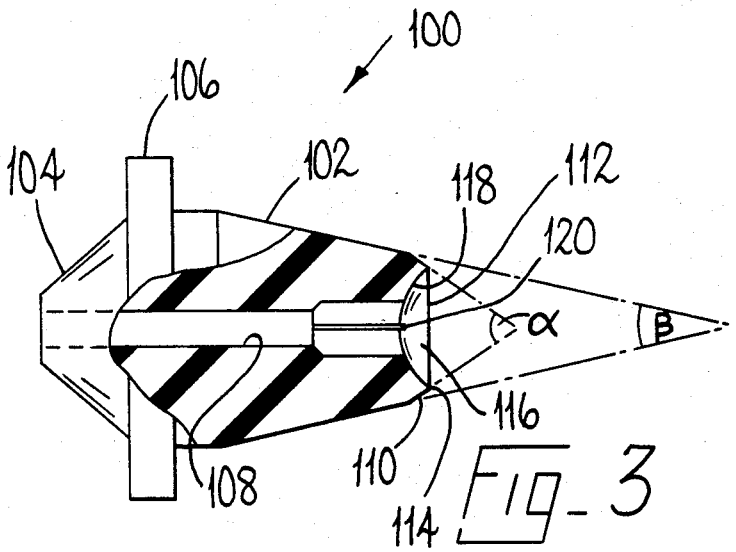
FIG. 3 is a side view, partly in section, of the illustrative applicator nozzle.
Figure 4:
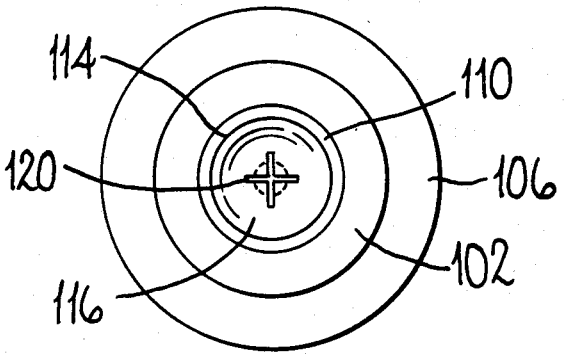
FIG. 4 is an end view of the illustrative applicator nozzle.

When using the applicator nozzle (100) as shown in FIGS. 3 and 4 of the drawings with the applicator device shown in FIGS. 1 and 2, the supply of adhesive to the applicator nozzle is controlled by the valve means (42). When a hot melt composition is required to be supplied to a surface of a workpiece, the valve means (42) is opened so that liquid composition supplied through the hose (8) may flow from the outlet port of the applicator device through the exit passageway (108) of the nozzle (100) and out of the orifice (12) into the depression (116) which provides a reservoir of adhesive.

The applicator device is held by an operator with the applicator nozzle (100) tilted with respect to the workpiece so that the central axis of the applicator nozzle is at a suitable angle to the workpiece surface (conveniently between 88° and 60°) and the adhesive guiding surface (118) of the lip of the nozzle makes an angle of between about 55° and about 83° with the surface of the workpiece (when no pressure is applied). Part of the lip (112) is brought into contact with the workpiece surface and a pool of composition from the reservoir (116) is formed on the workpiece. Pressure is applied to the nozzle which flexes the part of the lip contacting the surface, the pressure also opening one or both pairs of limbs of the orifice (120) depending on the orientation of the nozzle (100), facilitating flow of more composition into the reservoir in the depression (116). The nozzle is moved along the surface of the workpiece with the pool of adhesive preceding the deformed part of the lip (112) and a thin layer of composition escaping beneath said deformed part of the lip forming a band on the surface, the layer acting as a lubricant between said part of the lip and the surface. As the band is applied, composition in the reservoir is replenished by supply of fresh composition through the passageway (108) out of the orifice (120), the composition being supplied under pressure; the supply pressure may be adjusted to thereby adjust the rate at which composition is supplied to the reservoir to match the supply rate with the rate of use. If it is necessary to cease operation, the valve means (42) may be closed to cut off supply of liquid composition; upon the removal of pressure from the composition in the passageway (108) and on the nozzle from the workpiece surface, the orifice (120) closes so far as possible thus reducing the tendency of composition to leak from the orifice to a minimum. It is preferable that the outer surface (110) of the nozzle (100) does not come into contact with the band of composition applied to the surface so that the applied band is not disturbed. A leading part of the lip is spaced from the workpiece surface due to the tilt of the nozzle: were this leading part of the lip to contact the workpiece surface there would be a risk of damage to the nozzle.

As the nozzle is moved along the workpiece surface it may be necessary to follow a curved path, e.g. around the edge portion of a shoe sole, and the tilt of the nozzle is adjusted by the operator as the nozzle is propelled along the path, so that a trailing part of the lip is maintained in contact with the surface while a leading part is maintained spaced from the surface.

A band of hot melt composition may thus be conveniently applied to a workpiece surface, even around a curved path, using a hand-held applicator device, the width of the band being determined by the diameter of the spreading edge portion (114) and the thickness of the applied layer by the flexibility of the lip (112) which itself is dependent upon the hardness of the material from which the nozzle (100) is made together with the angle subtended by the surfaces (110, 118). The more flexible the lip, the thicker the applied layer of composition.

Whereas the applicator nozzle (100) is described herein associated with a hand-held applicator device, it will be appreciated that the nozzle (100) may also be used in a static applicator, for example as described in the specification of our copending patent application No. 8115976. An applicator nozzle in accordance with the invention, otherwise similar to the nozzle (100) may be mounted in an applicator device by means other than the flange (108) (which in that case may be absent), if desired. Further, a main body portion of a nozzle in accordance with the invention otherwise similar to the nozzle (100) may be made of a different material from the applicator portion, provided always that the applicator portion has suitable resiliency and flex characteristics.

In many cases, should composition harden or cure on the illustrative applicator nozzle, the cured composition may readily be peeled from the nozzle because most compositions do not adhere to silicone rubber. If the nozzle proves difficult to clean it may readily be removed from the applicator device and replaced by another similar nozzle.

I claim:

1. A method of applying a band of liquid adhesive composition to a surface of a workpiece using a frusto-conical applicator nozzle having an orifice with a semi-spherical depression therein and a circular lip therearound, comprising:

supplying liquid composition to the orifice so that the composition flows through the orifice providing a reservoir of composition in the semi-spherical depression, with the frusto-conical applicator nozzle tilted with respect to the work bringing part of the circular lip and the surface of the workpiece substantially into contact so that the reservoir of composition forms a pool on the surface of the workpiece, causing the flexible applicator portion to flex so that the applicator portion is deformed by contact with the workpiece surface, and bringing about relative movement between the applicator nozzle and workpiece so that composition from the pool is spread in a band on the surface by the applicator portion, the pool preceding the part of the lip which is substantially in contact with the surface of the workpiece considering motion of the applicator relative to the workpiece.

2. A method according to claim 1 in which the nozzle is tilted so that a central axis of the nozzle makes an angle of between 88° and 60° with the surface of the workpiece.

3. A method of claim 2 in which prior to flexing of the applicator portion a surface of the depression of the applicator portion adjacent the spreading edge portion makes an angle of between 55° and 83° with the surface of the workpiece.

* * * * *